United States Patent [19]

Vago

[11] 4,167,793

[45] Sep. 18, 1979

[54] PORTABLE BATHING APPARATUS

[75] Inventor: Robert E. Vago, Manlius, N.Y.

[73] Assignee: Diakinetics, Inc., East Syracuse, N.Y.

[21] Appl. No.: 818,848

[22] Filed: Jul. 25, 1977

[51] Int. Cl.[2] ..... A47K 3/12; A61G 7/08

[52] U.S. Cl. ..... 4/185 R; 4/185 L; 5/81 R

[58] Field of Search ..... 4/173, 185 B, 185 L, 4/185 R, 185 HB; 5/12 C, 63, 81 R

[56] References Cited

U.S. PATENT DOCUMENTS

| | | | |
|---|---|---|---|
| 2,603,796 | 7/1952 | Danielsen et al. | 4/173 R |
| 3,467,970 | 9/1969 | Ingemansson | 4/185 L |
| 3,686,696 | 8/1972 | Lanigan | 5/63 |
| 3,701,170 | 10/1972 | Bond | 5/81 R |
| 3,842,449 | 10/1974 | Geurtsen et al. | 4/173 R |
| 3,889,304 | 6/1975 | Loren | 4/185 L |

*Primary Examiner*—Steven L. Stephan
*Attorney, Agent, or Firm*—James Magee, Jr.

[57] ABSTRACT

The specification discloses apparatus which constitutes a portable bath-tub which is vertically adjustable to facilitate patient handling and transfer, bathing, draining after use, and cleaning. The apparatus includes a tub mounted within a frame, a platform upon which the patient can be placed in a supine posture, means for lowering the platform into the tub and raising it again, means for raising and lowering the frame and therefor the tub from a lower preset height to a greater height and wheel means on said frame to permit transfer from place to place.

1 Claim, 9 Drawing Figures

PORTABLE BATHING APPARATUS

BACKGROUND OF THE INVENTION

This invention relates to hospital equipment and more particularly to an apparatus for holding and bathing a hospital patient or other person unable to make use of ordinary bathing fixtures. The apparatus is designed to facilitate transfer of the patient from bed to bath, bathing, drying, return of the patient to the bed, and discharge of the used bath water.

In hospital or sick-room operation, one of the more difficult manipulative tasks is that of patient handling and transfer in connection with bathing and body cleansing operations. Many patients are unable to bathe themselves or to travel to a suitable bathing station. Although portable bathing units are available, they do not generally have sufficient water capacity to provide an adequate immersion bath, being primarily designed for use as a sponge bath.

It is an object of this invention to provide a portable bath tub unit for immersion bathing of hospital patients.

Another object of the invention is to provide a portable bath tub unit which can be positioned adjacent to a hospital bed with the patient receiving means on the same level as the bed to facilitate transfer of the patient from bed to bath.

Another object of the invention is to provide a bath tub unit which can be easily and conveniently moved from hospital room to bathing station, filled with water and emptied by means of standard hospital plumbing fixtures and equipment.

These and other related objects are achieved by providing a bath tub unit comprising a tub or water-containing reservoir generally resembling a standard home bath tub large enough to receive substantially all of the body and lower extremities of a patient; a frame to support and carry the tub, the frame being vertically adjustable, a body receiving and supporting platform which can be adjustably positioned within the tub; means for operating the unit by independently raising and lowering the framd and immersing the patient within the tub, and wheel means for moving the unit from place to place.

More specifically, the bathing unit of this invention comprises a tub or water reservoir suspended within a frame, mechanical means for vertically positioning the frame and associated tub; an immersible patient bathing rack or platform positioned at or slightly above the rim of the tub with associated means for lowering and raising the rack relative to the depths of the tub, wheel means on the frame for moving the unit from one location to another.

The means and apparatus for providing the benefits of the herein disclosed invention will be more clearly understood by reference to the accompanying drawings in which.

Figure 1:
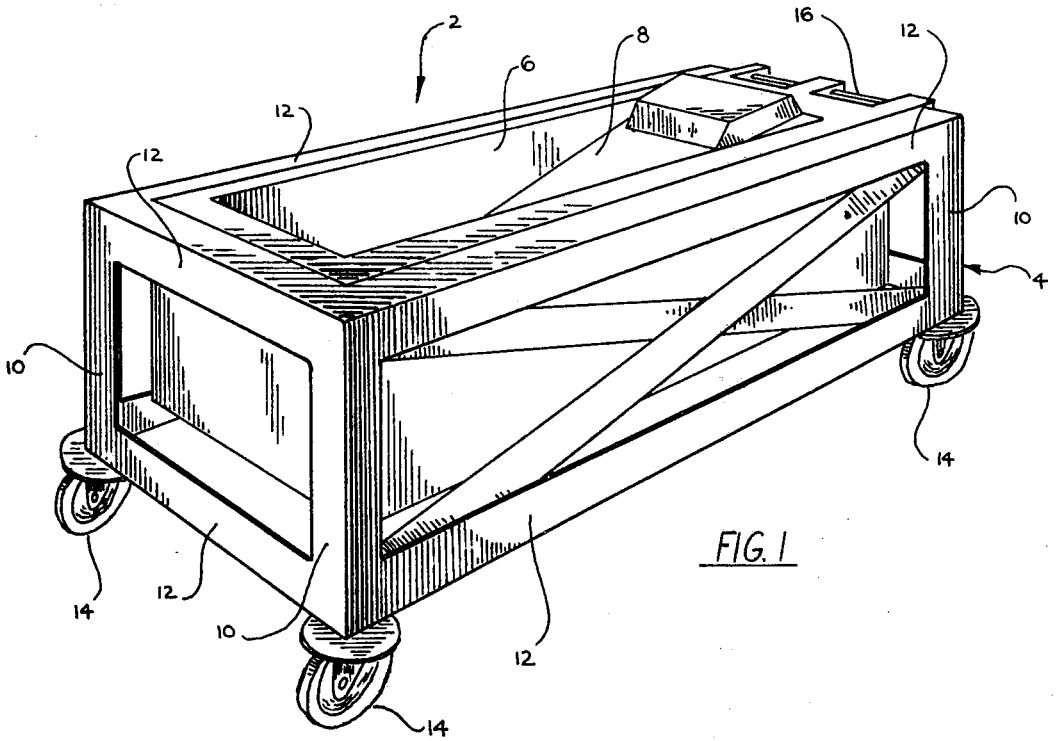
FIG. 1 is a perspective representation of a tub carried within a wheeled frame.
Figure 2:
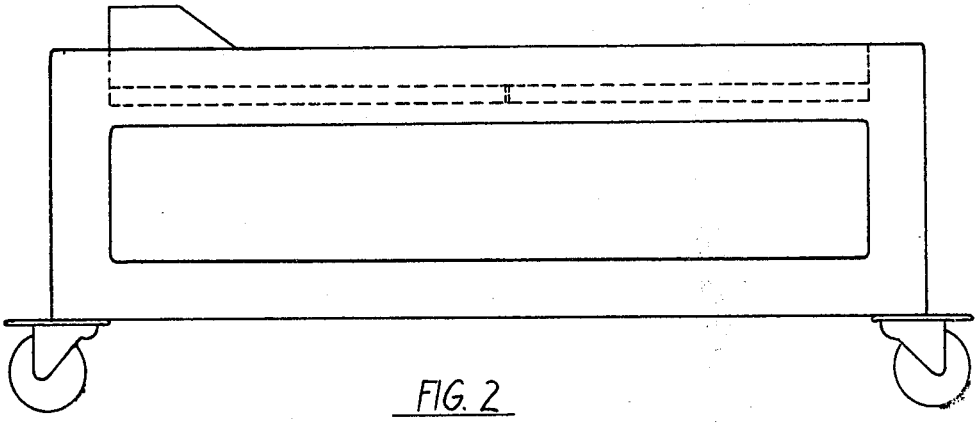
FIG. 2 is a side view of the unit showing a patient supporting platform in the supine position.

Referring now to FIG. 1, the portable bath apparatus shown generally as 2 having a frame shown generally at 4, a tub 6, and a body supporting platform member 8. The frame consists of 4 upright corner portions 10 and upper and lower horizontal sections 12 which taken together form a box-like structure adapted to receive the tub. The frame is provided with four caster wheels 14 located at each corner of the frame. The frame is also provided with a handle or gripping means 16 located at the head-end of the unit.

Figure 4:
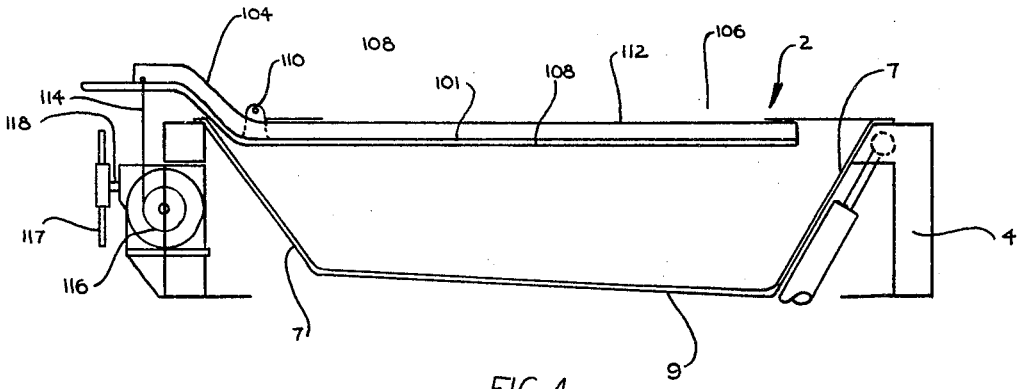
FIG. 4 is a schematic view partially in section 6 of a tube and associated platform in the raised or supine position.
Figure 5:
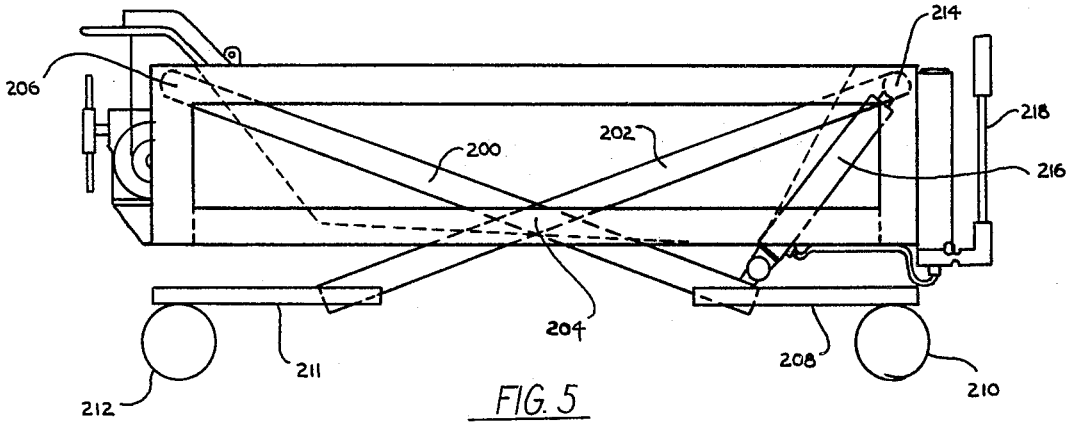
FIG. 5 is a side view of the frame and elevational mechanism.

Operative mechanical elements of one embodiment of the invention are shown in FIGS. 4 and 5.

Referring now to FIG. 4, the bath unit 2 comprises a frame 4, tub 6 and bathing platform 8. Tub 6 has end walls 7, bottom 9 and side walls, not shown. Platform 8 consists of a segmented rack 101 having a proximate end portion 102 with a pillow-like extension 104 at the head end and a distal portion 106 joined together by a hinge 108. Bathing platform 8 is cantilevered over the cavity of the tub 6 by means which include a pair of pivot pins, one of which is shown as 110. In this position, the platform is ready to receive a supine patient. Rack 101 can be made of any suitable light weight but strong material capable of supporting body weight and of being washed and disinfected. An ideal construction for the rack would be in the form of a grid or web of stainless steel or aluminum tubing. Rack 101 is provided with a water and detergent compatible flexible mattress 112 to receive and cushion the body of the patient. Generally, the mattress should be designed for easy handling, removability and replacement. Rack 101 is operated, i.e., lowered into the tub and raised therefrom, by means of cable 114, take-up drum 116 and handle 117. Handle 117 is connected to the take-up drum by a shaft 118 and if desired, suitable gearing not shown. The cable 114 is secured to the proximal end of rack 8 in such a manner as to balance the weight of the rack at the pivot points mentioned above. In combination the cable, drum, shaft and handle can be considered as a capstan which raises and lowers the platform into the tub.

Figure 3:
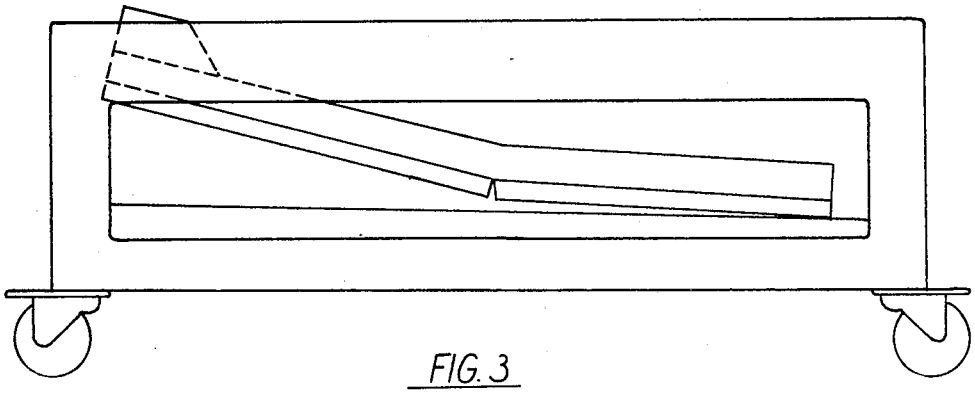
FIG. 3 is a side view showing the apparatus with the patient supporting platform in the immersed position.

In operation, as the platform 8 is lowered into the tub from the fully supine position shown in FIG. 4 the foot end of the distal portion 106 comes into contact with the floor of the tub. At this point, continued lowering causes hinge 108 to break or open, thus permitting further immersion until section 106 rests fully upon the floor 9 of the tub and section 102 is in a semi-reclining position such as that illustrated by dotted lines in FIG. 4 and in FIG. 3.

In FIG. 5, a mechanism for raising and lowering the tub and its associated frame is shown. Each of the longitudinal sides of the bath unit supporting frame 4 is provided with a pair of crossed beams 200 and 202 pivoted at a point 204 by means of a suitable pin or axle. Beam 200 is secured at its upper end to the frame so as to rotate about point 206. The lower end of beam 200 is secured to wheel chassis 208 which consists of a rectangular frame from which suitable caster wheel 210 depends. Beam 202 is provided with a corresponding wheel chassis 211 and wheel 212. It will be appreciated that a similar pair of beams are provided for the opposite side of the unit and wheel chassis. The upper end of beam 202 is provided with roller 214 which moves horizontally in a short track on the inside of the corresponding portion of frame 4. A power unit 216, either a hydraulic or pneumatic cylinder, is carried on the lower end of beam 200 immediately above the wheel chassis. The piston of the power unit is operatively connected to the upper end of beam 202 adjacent to roller 214. Power unit 216 is operated by handle 218. In operation extension of the power unit piston provides a vector force which bears upon the lower end of beam 200 and the upper end of beam 202. The beams pivot about pivot point 204, thus raising the upper end of both beams and the frame carried thereon. Horizontal displacement of the beam ends is accomodated by movement of roller 214 in its track and convergence of wheel chassis 211 and 210. By suitable design and control of the stroke length of the power unit, the distance through which the frame and tub are lifted can be controlled.

Figure 6:
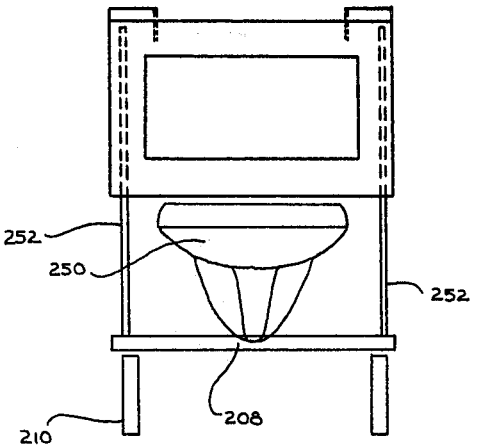
FIG. 6 is an end view, in schema, showing the frame elevated to a height sufficient to discharge the contents of the tub into a standard hospital discharge sink.

In FIG. 6 frame 4 is shown in fully elevated and positioned over a waste basin 250 for gravity discharge of the contents of the tub. Upright members 252, shown partially in dotted lines, represent beams 200 and 204 and corresponding opposite elements in their appropriate pivoted positions.

The portable bath apparatus of the invention is constructed and adapted to be positioned parallel and adjacent to a hospital bed with the platform raised and in the supine position. The patient can then be easily and safely transferred by lateral movement from the bed to the bath unit with a minimum of effort and discomfort. During such a transfer, the hinged joint between the segments of the rack can be locked or secured by any suitable means such as a bolt or linch pin arrangement. It is also desirable to provide a locking mechanism to secure the caster wheels, thus preventing movement of the unit during patient transfer. Since the height of the unit can be raised or lowered to any desired position, the rack or platform can always be positioned at the bed-height of the patient's bed.

Once the patient is transferred to the unit and is resting securely on the platform, the frame-tub-platform combination can be lowered to height convenient for transport and the unit wheeled to a bathing station where the tub can be filled with water to any desired level by means of either a built-in or extra-structral filling mechanism. Of course, if necessary, an already filled tub could be transported to the patient's room and used there immediately upon transfer of the patient to the platform. Once the tub is properly filled, tha patient immersing mechanism is activated and the rack or platform is tilted downwardly into the bath water. The patient is immersed in the bath-water to the desired degree by controlling the mechanism which operates the rack. If maximum immersion is desired, either to soak a maximum of body surfaces or to minimize exposure of the patient, the rack is lowered until the distal portion contacts and ultimately rests upon the floor of the tub. The distal portion of the rack or mattress can be provided with a footrest or support against which the patient can place his feet in order to prevent sliding at positions intermediate the sitting posture of fully lowered and the supine posture of fully raised.

The height of the tub can be adjusted to accommodate the stature of those bathing the patient by operation of the frame-adjusting mechanism. Once bathing is completed, the patient can be easily raised from the bath water and returned to the supine position for drying. The tub can then be position for discharge of the used bath-water through a drain into the standard hospital waste system. With the patient in the supine position, the unit is then transported back to the hospital room where the unit is placed adjacent to and level with the bed for transfer of the patient to the bed.

Figure 7:
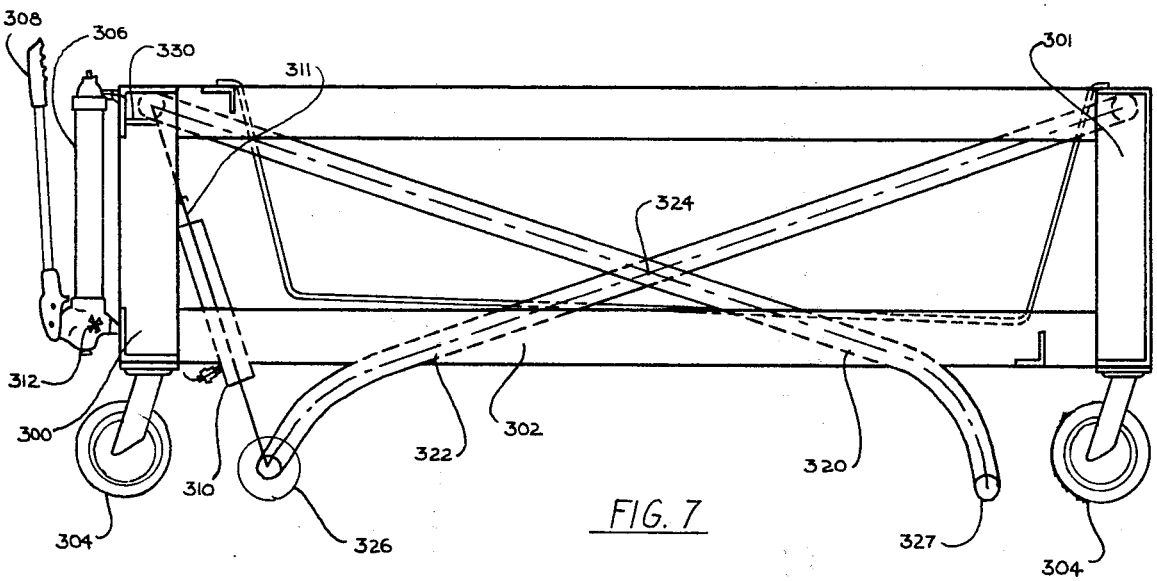
FIGS. 7 through 9 illustrate a preferred embodiement of the invention in which power for operation of the moving elements of the bath unit is supplied by a pneumatic or hydraulic system and stabilization is provided by supporting means operatively connected to the frame-raising mechanism.

In FIG. 7 the generally box-shaped frame consists of upright corner posts, two of which are shown as 300 and 301, a parallel pair of lower horizontal beams, one of which is shown as 302 and a parallel pair of upper horizontal beams not shown. A caster wheel 304 is secured to the bottom of each upright. Attached to the frame is a fluid pump having operating handle 308 and conduits connected with power cylinder 310. The fluid pump is fitted with a three-way valve and an external control 312 for directing the fluid flow to a selected power cylinder.

The frame and tub lifting mechanism comprises two pairs of pivoted scissor beams, one pair of which comprises beams 320 and 322, pivoted at point 324 by a pin or axle. The upper end of beam 322 is pivotally secured to upright 301. The lower end of beam 322 is pivoted with rolling means 326 which is adapted to roll longitudinally. The upper end of beam 320 is adapted to travel in track 330 provided in the upper horizontal frame member. The lower end of beam 322 and upper end of beam 320 are operatively connected to power cylinder 310 and the piston 311 thereof so that extension of the piston displaces said beams raising the frame and tub to the position shown in FIG. 8.

Figure 9:
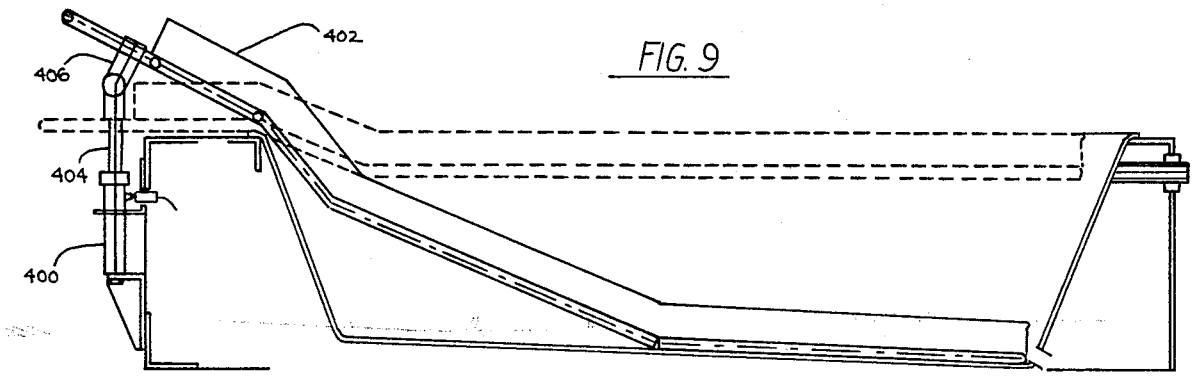

By means of the valve control 312 power from pump 306 can be transferred via a suitable conduit, not shown, to cylinder 400 shown in FIG. 9, which is operatively connected to platform 402 by piston 404 and pivot arm 406. Extension of the piston will tilt the rack downwardly into the tub.

Figure 8:
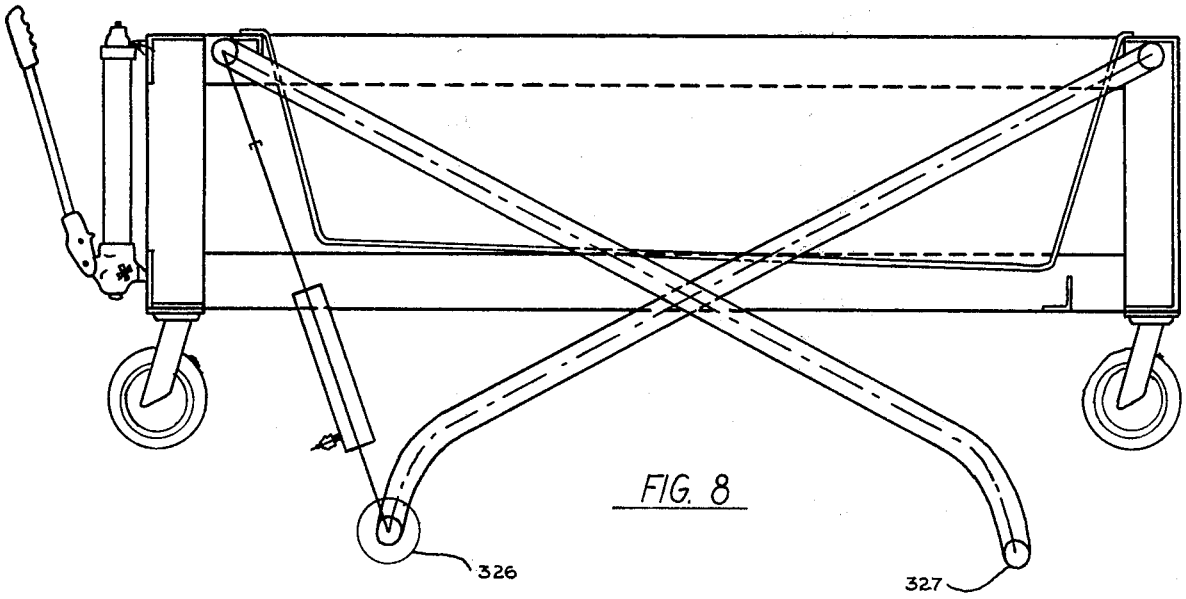

In FIG. 8, the frame and tub are shown in the raised position supported on wheel 326 and support member 327. Wheels 304 have been elevated thus preventing accidental movement of the unit. Since support member 327 is non-rolling, e.g., a metal tube or shaft welded to the ends of beam 320 and corresponding beam on the opposite side of the unit, any tendency for wheels 326 to revolve is minimized.

By referring to FIGS. 7 and 8 the basic lifting mechanism and its operation can be seen. The upper end of beam 322 is fixed to the frame. The lower ends of both beams 320 and 322 are free and the upper end of beam 320 is designed for limited movement in a generally horizontal plane within a track provided in the frame. As the beam pivot around pivot pin 324 the upper ends of the beams raise and converge slightly while the lower ends converge by virtue of the rollability of wheel 326. Support member 327 remains substantially stationary.

FIG. 9 illustrates a portable bath unit with the platform in the lowered position with the distal segment resting on the bottom of the tub, the hinge open, and the power cylinder piston extended.

What is claimed is:

1. A portable bathing tub for use in the care of invalids and incapacitated patients, said tub having a frame consisting of upright corner posts having wheels at the lower ends thereof, connecting upper and lower horizontal beams joining said posts; a tub having an upper rim, side walls, and a bottom forming the cavity of said tub, the tub being mounted within said frame; means for raising and lowering said frame vertically; a body-supporting platform, having a head end and a foot end, tiltably cantilevered over the tub from the upper rim thereof, the head end being supported by said rim and the foot end extending over the tub, said platform having a hinge located between the head end and the foot end; and means for immersing said platform within the cavity of the tub by tilting the head end of said platform downward into said cavity so that the foot end engages the bottom of the tub and as the head end continues tilting, the foot end pivots about the hinge and comes to rest generally parallel to and adjacent to the bottom of the tub.

* * * * *